United States Patent [19]

Urushizaki

[11] 4,097,328

[45] Jun. 27, 1978

[54] TAPE CUTTER

[76] Inventor: Sakae Urushizaki, c/o Nishidotonbori Corpo, No. 4-1, 5-chome, Nishidotonbori-dori, Nishi-ku, Osaka-shi, Osaka-fu, Japan

[21] Appl. No.: 830,793

[22] Filed: Sep. 6, 1977

[30] Foreign Application Priority Data

Mar. 9, 1977 Japan ..... 52-29083

[51] Int. Cl.[2] ..... B32B 31/00; B44C 7/00

[52] U.S. Cl. ..... 156/523; 156/577

[58] Field of Search ..... 156/523, 577

[56] References Cited

U.S. PATENT DOCUMENTS

| | | | |
|---|---|---|---|
| 3,523,053 | 8/1970 | Zbinden et al. | 156/523 |
| 3,850,779 | 11/1974 | Pearson | 156/523 |

*Primary Examiner*—Douglas J. Drummond

[57] ABSTRACT

A tape cutter used to apply a cellophane adhesive tape and cut it automatically. It includes a spring-loaded swing member, a tape press roller mounted on the bottom of the swing member, a blade carrying disc mounted to be rotatable as the swing member is pivoted up and down.

1 Claim, 5 Drawing Figures

TAPE CUTTER

The present invention relates to a tape cutter and, more particularly to a tape cutter used to cut a cellophane adhesive tape.

Such a tape is usually manually pulled out of its roll for a desired length, cut off the roll and use to seal e.g. an envelope. It will be understood from experience that this work is considerably troublesome owing to the adhesive nature of tape.

An object of this invention is to provide a tape cutter which is convenient and easy to use and is inexpensive to produce.

Another object of this invention is to provide an adhesive tape cutter with which the tape can be cut automatically after it has been applied.

Other features and advantages of this invention will become apparent from the following description with reference to the accompanying drawings, in which.

Figure 1:
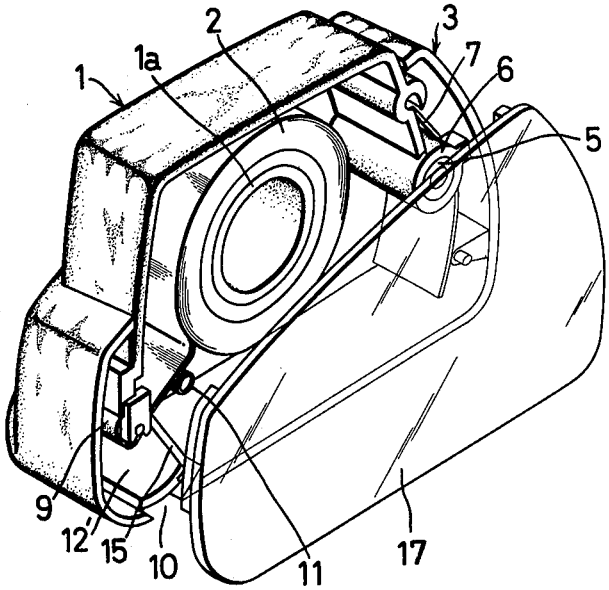
FIG. 1 is a perspective view of the tape cutter according to this invention with the side plate removed.

A swing member 1 is mounted on a cutter body 3 to be swingable with respect to said body about its tubular portion 6 removably mounted on a shaft 5 projecting laterally from a side plate 4 of the body 3. The swing member 1 is a hollow casing open at one side. A tubular tape mount 1*a* projects inwardly from the other side thereof to hold a cellophane adhesive tape roll 2 rotatably.

The swing member 1 is upwardly urged by a flat spring 7 which has its lower end fixed to the body 3 and its upper end bearing on the swing member. The protrusion of the swing member 1 above the body 3 is limited by a stopper 8.

A tape press roller 9 is rotatably pivoted at the left-hand bottom of the swing member 1. When the latter is pivoted down against the resilience of the spring 7, the tape press roller slightly protrudes out of an opening 10 in the bottom of body 3.

A tape guide bar 11 projects laterally from the side plate of the swing member 1 to guide the adhesive tape 2 from the roll so as for its leading end 2*a* to slightly protrude out of the opening 10 when the swing member is pushed down.

Figure 2:
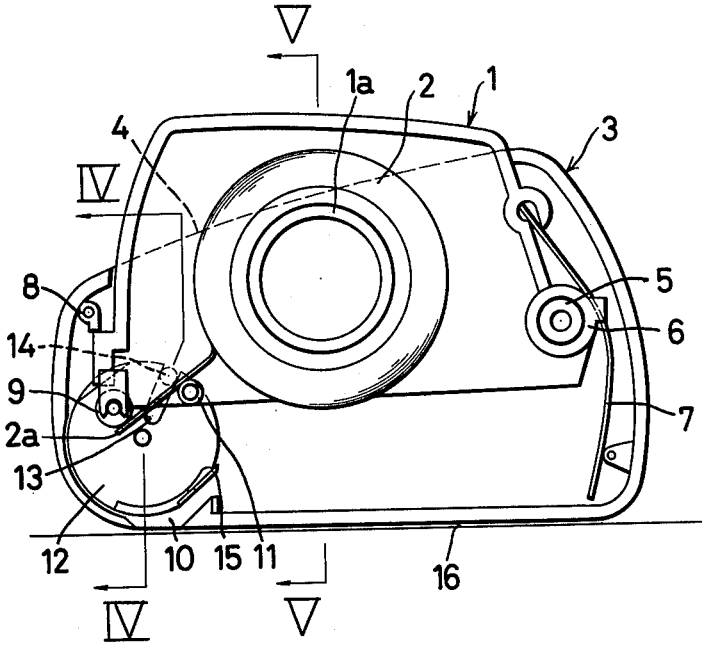
FIG. 2 is a side view thereof with the swing member in its upper position.

A blade mounting disc 12 is rotatably pivoted in a recess in the side plate 4 of the body to be disposed between the side plates of the body 3 and of the swing member. The disc 12 is formed with a radial slit 13 in which fits a pin 14 projecting rearwardly from the back side of the swing member 1. A cutting blade 15 is obliquely mounted on a blade carrying portion 12' projecting laterally from the disc 12. The blade 15 is normally in its cutting position as shown in FIG. 2. When the swing member 1 is pivoted down, the disc 12 rotates clockwise to bring the blade away from its cutting position since the pin 14 engages the slit 13.

Figure 3:
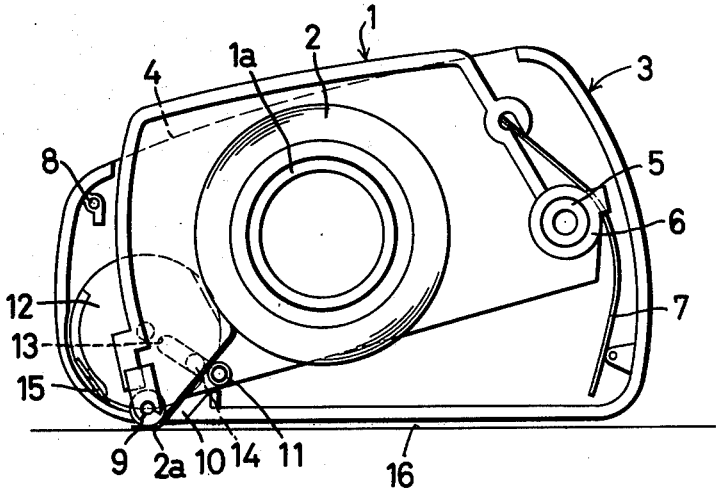
FIG. 3 is a view similar to FIG. 2 but with the swing member in its lower position for tape adhesion.
Figure 4:
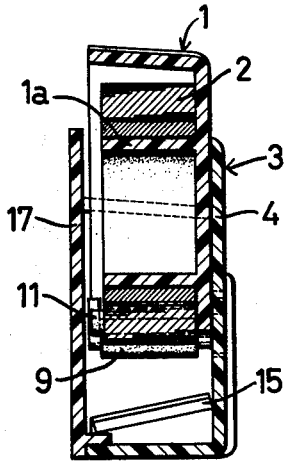
FIG. 4 is a vertical sectional view taken along the line IV—IV in FIG. 2.
Figure 5:
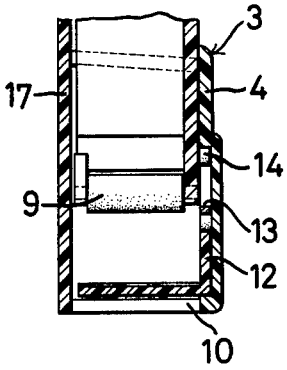
FIG. 5 is a partial vertical sectional view taken along the line V—V in FIG. 2.

In operation, the tape cutter according to this invention is placed on a surface to be sealed 16 and the swing member 1 is pivoted down to the position for adhesion shown in FIG. 3 to cause the tape press roller 9 and the leading end 2*a* of tape to protrude out of the opening 10. When the tape cutter is slid on the surface 16 to this side with the tape pressed against the surface by the tape press roller 9, the tape is adhered to the surface. When a desired length of tape has been put thereon, the swing member is then released to allow it to return to its normal position under the resilience of flat spring 7. The tape press roller 9 will withdraw into the body 3, and the disc 12 and thus the blade 15 rotate counterclockwise to cut the adhesive tape off its roll.

The other side plate 17 of the body 3 is removable to set a new tape roll on the tubular tape mount 1*a*. As mentioned before, the tape guide bar 11 serves to guide the tape end 2*a* to a position suitable for adhesion.

It will be understood from the foregoing description that the tape cutter according to the present invention provides a much easier, simpler means for applying an adhesive tape, compared with the conventional method. All that are needed is to place the tape cutter on the surface to be sealed, press down the swing member, slide the cutter thereon to apply the tape, and release the swing member to cut it. Because of a simple construction, it can also be manufactured at a moderate cost.

I claim:

1. A tape cutter for adhesive tape comprising:

a body, a swing member pivoted on said body to be pivotable about one end thereof, urged upwardly by a spring, to hold an adhesive tape roll rotatably, a tape press roller rotatably pivoted on the bottom of said swing member at the other end thereof, said tape press roller and the leading edge of said adhesive tape adapted to protrude through an opening in the bottom of said body when said swing member is pivoted down, a disc rotatably pivoted on said body to be disposed between the side plates of said body and of said swing member and to be rotatable as said swing member is pivoted up and down, and a blade mounted on said disc to cut the adhesive tape when the swing member is released to pivot up.

* * * * *